US005542133A

United States Patent [19]

Makino et al.

[11] Patent Number: 5,542,133

[45] Date of Patent: Aug. 6, 1996

[54] SANITARY DEVICE

[75] Inventors: Tetsuo Makino, Okazaki; Hideki Furukawa, Toyota; Osamu Matsubara, Kariya; Atsushi Sawaki, Taketoyo-cho; Shinji Kawai, Wakabayashihigashi-machi, all of Japan

[73] Assignee: Aisin Seiki Kabushiki Kaisha, Kariya, Japan

[21] Appl. No.: 314,272

[22] Filed: Sep. 30, 1994

[30] Foreign Application Priority Data

Sep. 30, 1993 [JP] Japan ..... 5-245312

[51] Int. Cl.[6] ..... E03D 9/08

[52] U.S. Cl. ..... 4/420.4

[58] Field of Search ..... 4/420.4, 420.5, 4/447, 448

[56] References Cited

U.S. PATENT DOCUMENTS

| | | | |
|---|---|---|---|
| 4,208,746 | 6/1980 | Minamoto et al. . | |
| 4,551,868 | 11/1985 | Kawai et al. | 4/420.4 X |
| 4,841,582 | 6/1989 | Matsui et al. . | |
| 4,933,997 | 6/1990 | Kaneko | 4/420.4 |
| 5,208,922 | 5/1993 | Machinaga et al. . | |

FOREIGN PATENT DOCUMENTS

| | | | |
|---|---|---|---|
| 62-170624 | 7/1987 | Japan . | |
| 4060030 | 2/1992 | Japan | 4/420.4 |
| 4064630 | 2/1992 | Japan | 4/420.4 |
| 2142055 | 1/1985 | United Kingdom . | |

*Primary Examiner*—Robert M. Fetsuga
*Attorney, Agent, or Firm*—Oblon, Spivak, McClelland, Maier & Neustadt, P.C.

[57] ABSTRACT

A sanitary device is comprised of a tank storing an amount of water, a water pressure source, a cylinder, a nozzle pipe slidably fitted in the cylinder such that across the nozzle pipe a base side chamber and a distal side chamber are defined in the cylinder, a return spring accommodated in the distal side chamber and urging the nozzle pipe toward the retracted position thereof, and a control device serving for establishing either a first fluid communication between the tank and the base side chamber or a second fluid communication between the tank and the distal side chamber in such a manner that the first fluid communication brings the nozzle pipe into its operating position for ejecting the water while the water pressure is being supplied to the tank and the second fluid communication, together with the return spring, brings the nozzle pipe into its retracted position.

1 Claim, 7 Drawing Sheets

SANITARY DEVICE

BACKGROUND OF THE INVENTION

The resent invention relates to a sanitary device, and in particular to a sanitary device in which a nozzle pipe is expected to be transfered from a retracted position to an operating position by a fluid pressure.

One of the conventional sanitary devices is disclosed in Japanese Patent Laid-open Print No. Sho62-170624 published on Jul. 27, 1987 without examination. In this sanitary device, a nozzle pipe is slidably fitted in a cylinder such that a chamber is defined therebetween. When a water under pressure is supplied to the chamber, the nozzle pipe is extended, against a biasing force of a return spring, to an operating position and the water is injected from the distal end of the nozzle pipe toward a portion of a user sitting on a toilet bowl for washing the portion. After such a washing, the nozzle pipe is expected to be returned to its retracted position by using the biasing force of the return spring.

However, the retracting movement of the nozzle pipe should be established against a pressure which resides in the chamber, thereby disturbing a quick return or retracting movement of the nozzle pipe.

SUMMARY OF THE INVENTION

It is, therefore, a principal object of the present invention is to provide a sanitary device without the foregoing drawback.

Another object of the present invention is to provide a sanitary device in which when a nozzle pipe during its retracting movement is expected to be assisted by a water pressure as well as a biasing force of a return spring.

In order to attain the foregoing objects, a sanitary device is comprised of a tank storing an amount of water, a water pressure source, a cylinder, a nozzle pipe slidably fitted in the cylinder such that across the nozzle pipe a base side chamber and a distal side chamber are defined in the cylinder, a return spring accommodated in the distal side chamber and urging the nozzle pipe toward the retracted position thereof, and a control device serving for establishing either a first fluid communication between the tank and the base side chamber or a second fluid communication between the tank and the distal side chamber in such a manner that the first fluid communication brings the nozzle pipe into its operating position for ejecting the water while the water pressure is being supplied to the tank and the second fluid communication, together with the return spring, brings the nozzle pipe into its retracted position.

BRIEF DESCRIPTION OF THE DRAWINGS

The above and other objects, features and advantages of the present invention will be more apparent and more readily appreciated from the following detailed description of preferred exemplarily embodiment of the present invention, taken in connection with the accompanying drawings, in which.

DESCRIPTION OF A PREFERRED EMBODIMENT

A preferred embodiment of the present invention will be described hereinunder in detail with reference to the accompanying drawings.

Figure 1:
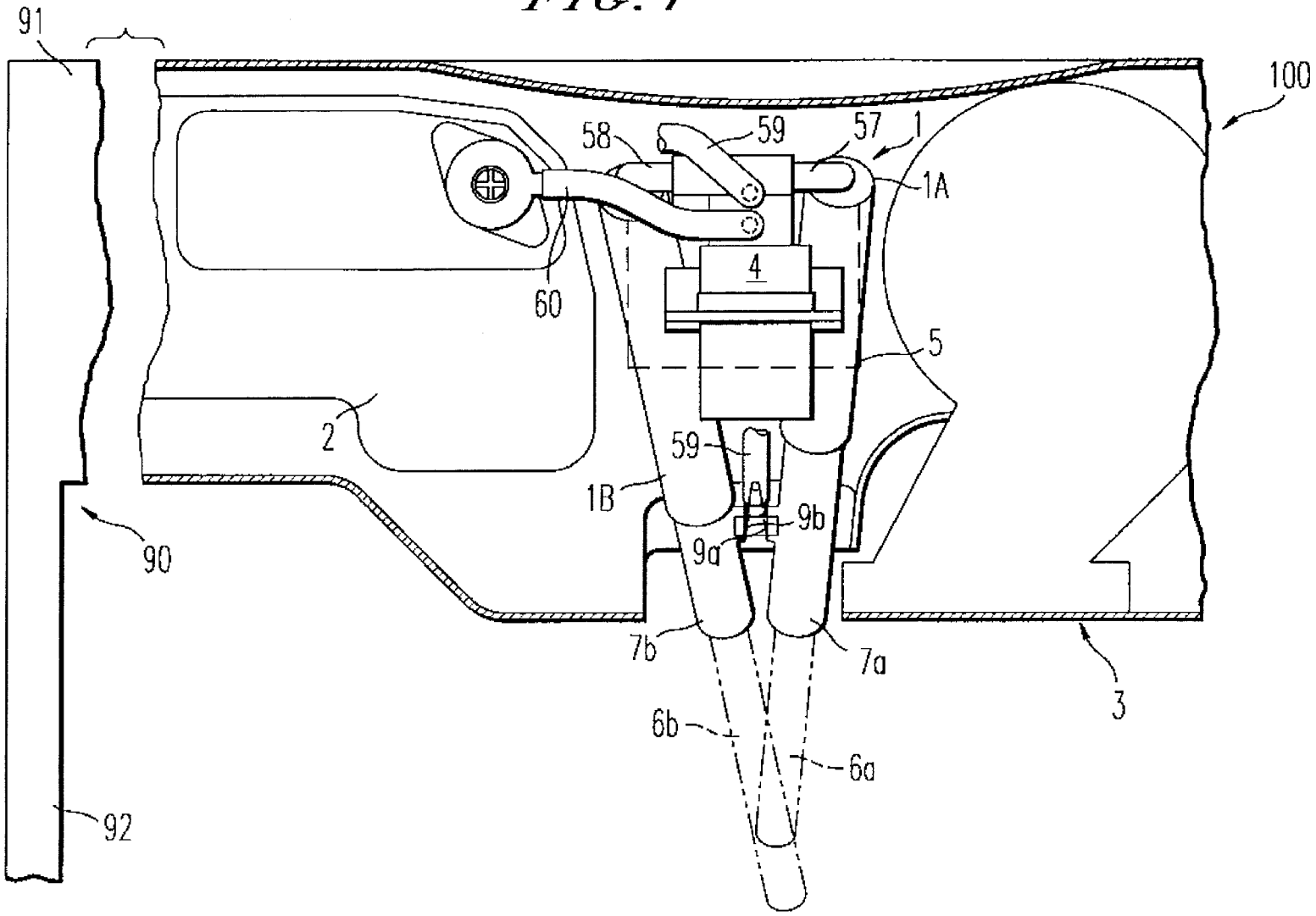
FIG. 1 shows a principal portion of a sanitary device in accordance with the present invention.

Referring first to FIG. 1, a sanitary device 100 includes a toilet bowl 90 having a rear portion 91. On the rear portion 91 of the toilet bowl 90, there is fixedly mounted a washing mechanism 3 which is mainly constituted by a nozzle device 1 and a tank 2.

The nozzle device 1 includes a first nozzle mechanism 1A for washing the anus portion of a user (not shown) on a seat (not shown) of the toilet bowl 90 and a second nozzle mechanism 1B for washing the public portion of the user if the user is a female. An amount of water stored in the tank 2 and is expected to be warmed up to a temperature and the resultant temperature remains unchanged by means of a heater 89 (cf. FIG. 8) which is under the control of a micro-processor or CPU 80. When a pressure is applied, as will be detailed later, to the tank 2, the pressure urges the water under pressure to either the first nozzle mechanism 1A or the second nozzle mechanism 1B via a distribution or changeover valve 4 which is secured to a stationary wall 5.

Figure 2:
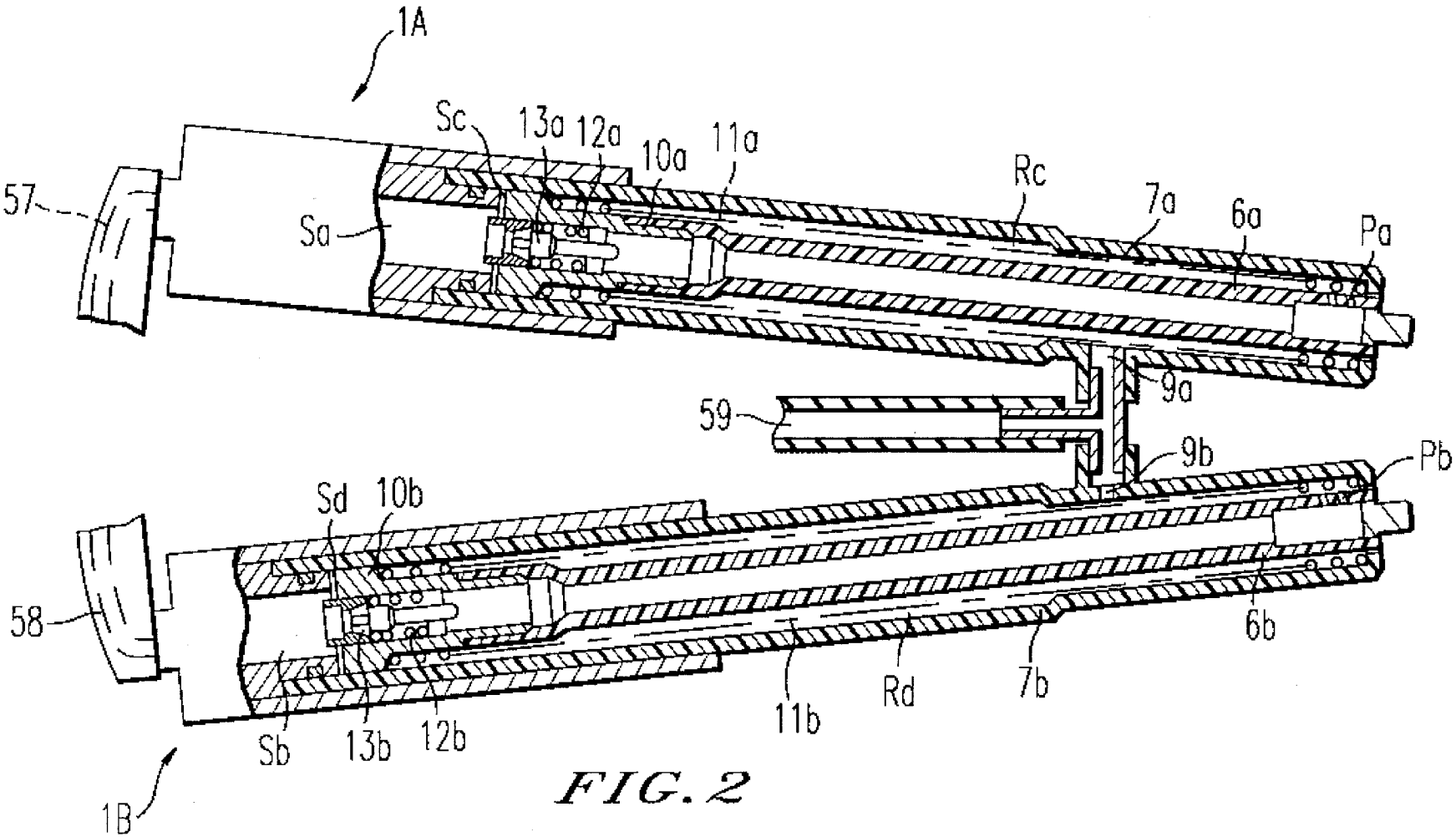
FIG. 2 is a cross-sectional view of a washing mechanism in the sanitary device shown in FIG. 1.

As best seen in FIG. 2, the first nozzle mechanism 1A (the second nozzle mechanism 1B) includes a nozzle pipe 6*a* (6*b*) which is formed at its distal end with a plurality of holes Pa (Pb). The nozzle pipe 6*a* (6*b*) is movably fitted in a cylinder 7*a* (7*b*) and is oriented toward an inner space 92 of the toilet bowl 90. The cylinder 7*a* (7*b*) is provided at its base portion and distal end side portion with an inlet opening Sa (Sb) and an outlet opening 9*a* (9*b*), respectively. Within the base portion of the cylinder 7*a* (7*b*), there is provided a piston portion 10*a* (10*b*), by which are defined a base side chamber Sc (Sd) including the inlet opening Sa (Sb) and a distal side chamber Rc (Rd) including the outlet opening 9*a* (9*b*). Within the distal side chamber Rc (Rd), there is disposed a spring 11*a* (11*b*) for urging the nozzle pipe 6*a* (6*b*) to its retracted portion. Within the piston portion 10*a* (10*b*), there is provided a valve body 13*a* (13*b*) urged by a spring 12*a* (12*b*) whose biasing force or spring constant is set to be greater than that of the spring 11*a* (11*b*).

Figure 4:
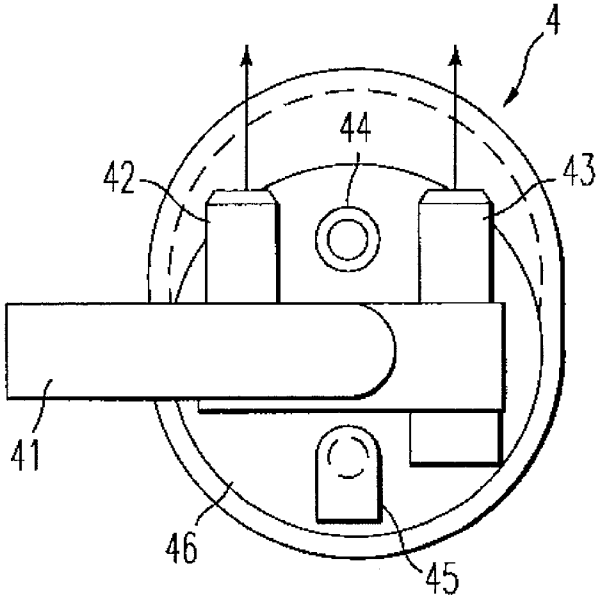
FIG. 4 is a front view of the changeover valve shown in FIG. 3.
Figure 3:
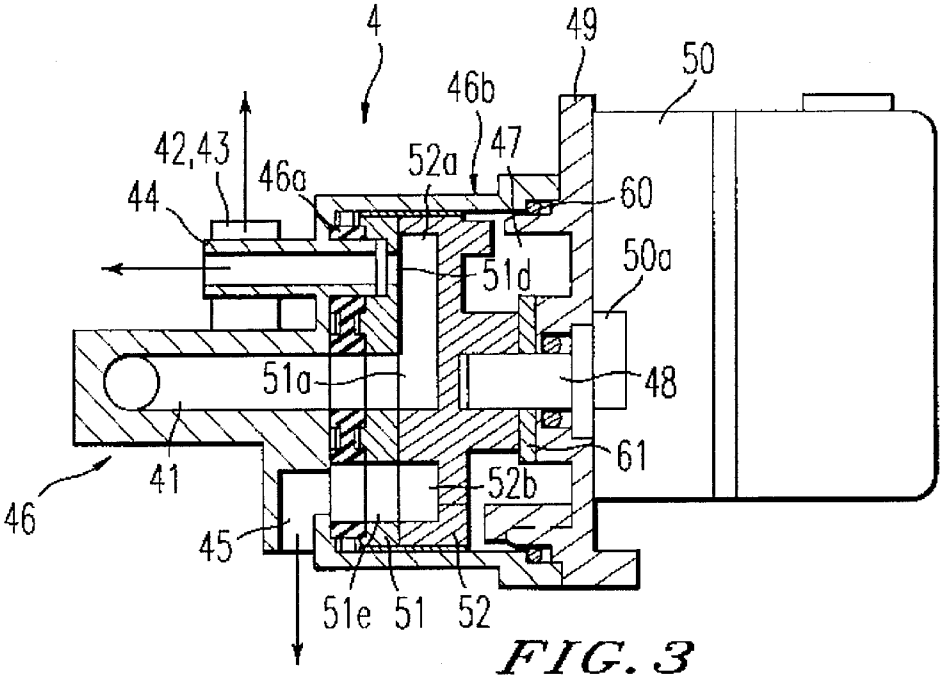
FIG. 3 is a cross-view of a changeover valve.

The distribution valve 4 includes, as best seen from FIGS. 3 and 4, a casing 46 which has a inlet passage 41 for receiving water from the tank 2, a first outlet passage 42 for supplying water to the base side chamber Sc via the inlet opening Sa, a second outlet passage 43 for supplying water to the base side chamber Sd via the inlet opening Sb, a return passage 44 connected to both of the outlet openings and 9*a* and 9*b*, and a train passage 45 exposed to the inner space 92 of the toilet bowl 90.

Figure 5:
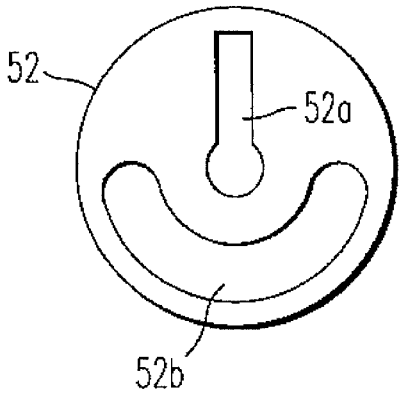
FIG. 5 is a front view of a rotary plate of the changeover valve shown in FIG. 3.

The casing 46 has a center portion 46*b* in the form of a cylindrical shape and a side wall 46*a* located at a middle portion thereof. A right side of the center portion 46*b* is closed by a member 49, thereby defining a valve chamber 47 therebetween. A motor 50 with a reducer 50*a* is secured to the member 49 and a driven shaft 48 of the reducer 50*a* extends into the valve chamber 47 after passing through the member 49. In the valve chamber 47, the shaft 48 is fixedly secured with a rotary plate 52. The rotary plate 52 is provided at a left surface thereof with a first passageway 52*a* which extends in the radial direction and a second passageway 52*b* which extends along a circumferential direction as best seen from FIG. 5.

Figure 6:
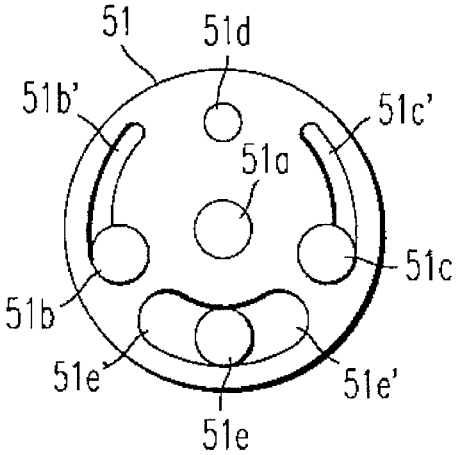
FIG. 6 is a front view of a stationary plate of the changeover valve shown in FIG. 3.

As shown in FIG. 3, in the valve chamber 47, in addition, a stationary plate 51 is provided so as to be positioned adjacent to the left surface of the rotary plate 52. As best shown in FIG. 6, the stationary plate 51 has a first passageway 51*a* at its central portion which is being in fluid communication with the first inlet passage 41. At an outer peripheral portion of the stationary plate 51, there are formed a second passageway 51*b* being in fluid communication with the first outer passage 42, a third passageway 51*c* being fluid communication with the second outlet passage 43, a fourth passageway 51*d* being fluid communication with the return passage 44, and a fifth passageway 51*e* being fluid communication with the drain passage 45.

Figure 7:
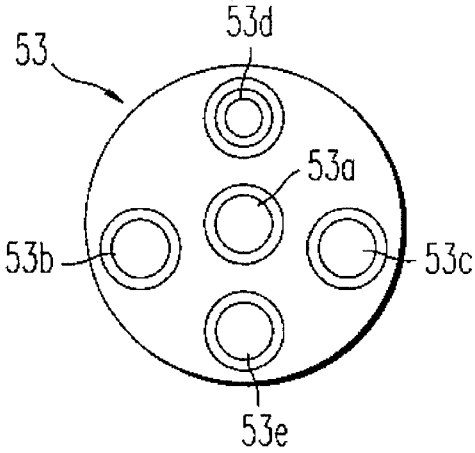
FIG. 7 is a front view of an elastic member of the changeover valve shown in FIG. 3.

As seen in FIGS. 3 and 7, an elastic member 53 which is made of a rubber or elastomer is interposed between the wall 46*a* of the casing 46 and the stationary plate 52 in order to establish a fluid-tight relationship therebetween. The elastic member 53 is provided therein with holes 53*a*, 53*b*, 53*c*, 53*d* and 53*e* corresponding to the passageways 51*a*, 51*b*, 51*c*, 51*d* and 51*e*, respectively. Thus, each of fluid communication mentioned in the previous paragraph can be kept as is expected without fluid leakage. As a raw material of each of the rotary plate 52 and the stationary plate 51, a ceramics is employed.

Figure 8:
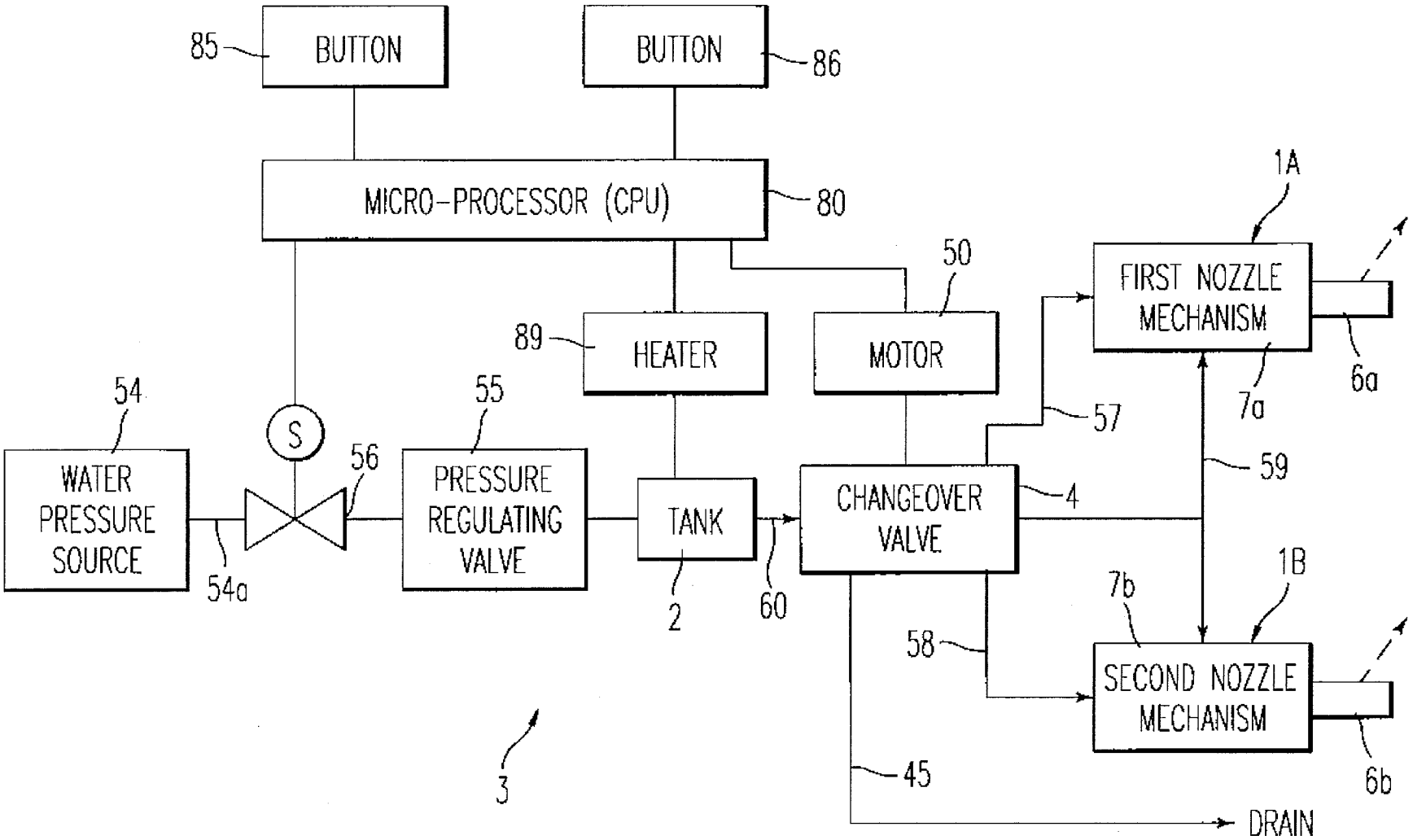
FIG. 8 is a block diagram of a hydraulic circuit for the sanitary device shown in FIG. 1.
Figure 9A:
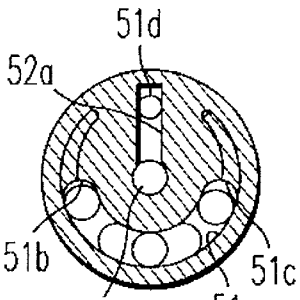
FIG. 9 and FIG. 10 show an operation of the sanitary device in accordance with the present invention.
Figure 9B:
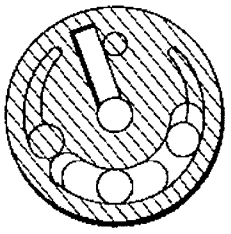
Figure 9C:
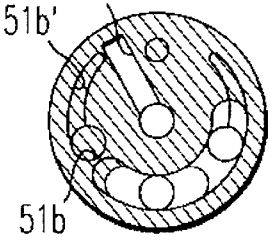
Figure 9D:
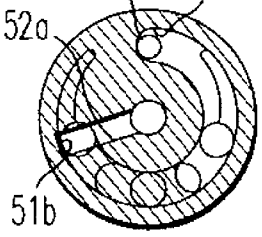
Figure 9E:
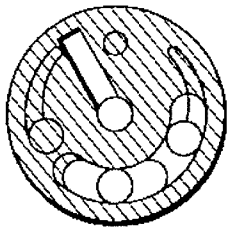
Figure 9F:
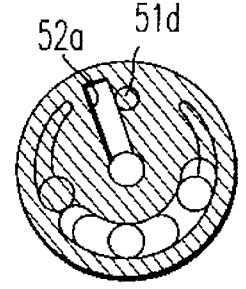
Figure 10A:
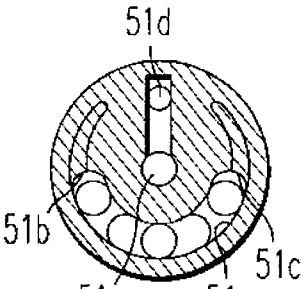
Figure 10B:
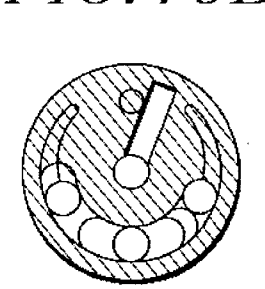
Figure 10C:
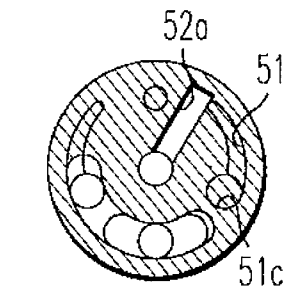
Figure 10D:
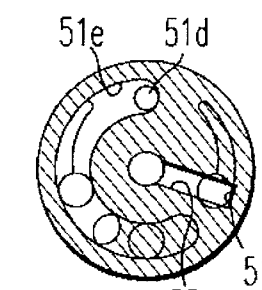
Figure 10E:
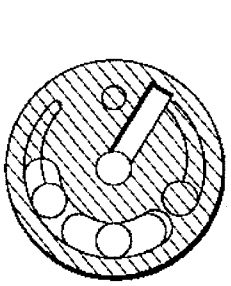
Figure 10F:
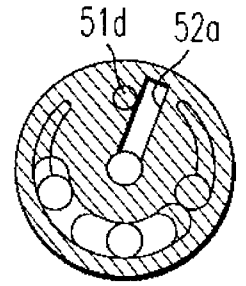

Referring now to FIG. 8 wherein a diagram of a hydraulic circuit for the sanitary device 100 is illustrated, the tank 2 is connected to a fluid pressure source 54 in the form or a source of water supply via an electromagnetic opening and closing valve 56 and a pressure regulating valve 55. The pressure regulating valve 55 is used for regulating the pressure of the water contained in the tank 2. The electromagnetic opening and closing valve 56 is a normally closed valve and is set to be brought into an opened condition, by order of the micro-processor or CPU 80, when the anus or the female's pubic portion is desired to be washed. A pipe 60 is disposed between the tank 2 and the inlet passage 41 of the changeover valve 4. The first outlet passage 42 and the second outlet passage 43 are connected to the inlet opening Sa of the cylinder 7*a* and the inlet opening Sb of the cylinder 7*b* via a pipe 57 and a pipe 58, respectively. The return passage 44 of the changeover valve 4 is connected via a bifurcated pipe 59 to both of the outlet opening 9*a* of the cylinder 7*a* and the outlet opening 9*b* of the cylinder 7*b*. It is to be noted that during a retracting movement of the nozzle pipe 6*a* (6*b*) the electromagnetic opening and closing valve 56 is expected to be opened temporally in order to supply the fluid pressure inlet passage 41 of the control valve 4.

While the the nozzle pipe 6*a* (6*b*) is at its retracted position as shown in FIG. 2, the rotary plate 52 of the changeover valve 4 is in its waiting position (A) as shown in FIG. 9. Under such a condition (A), the passageways 51*a*, 51*b* and 51*c* are in fluid communication with the second passageway 52*b* for drain the water, and the passageways 51*a* and 51*d* are in fluid communication with each other via the passageway 52*a*.

Figure 11:
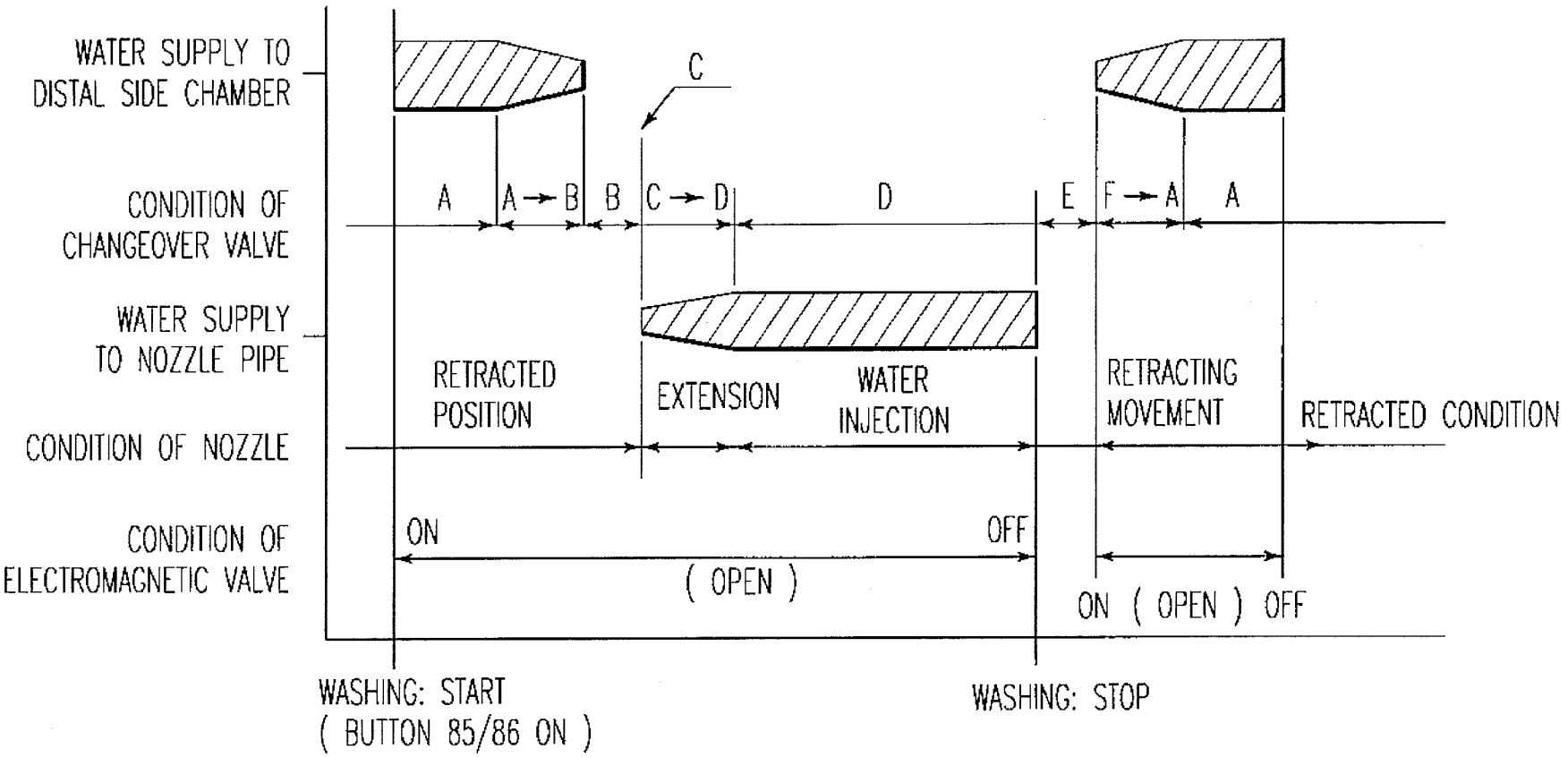
FIG. 11 is a timing chart for the operation of the sanitary device in accordance with the present invention.

When a washing button 85 (FIGS. 8 and 11) for anus washing is turned on, the CPU 80 orders to opened the electromagnetic opening and closing valve 56. Simultaneously, the CPU 80 also makes the motor 50 to turn on for initiating a rotation of the rotary plate 52. Due to the resultant rotation of the rotary plate 52, the fluid communication between the passageway 51*a* and the passageway 51*d* is brought into interruption (condition B in FIG. 9). Since the rotary plate 52 continues to rotate, condition (C) in FIG. 9 is established. Under such condition, the passageway 51*a* of the rotary plate 52 begins to establish a fluid communication between the passageway 51*a* and the passageway 51*b* including the groove 51*b*, and the washing water under pressure begins to be supplied to the base side chamber Sc of the first cylinder 7*a* via the inlet opening Sa. In accordance with further rotation of the rotary plate 52, due to the groove 51*b* which extends in the circumferential direction, the amount of the washing water is increased gradually, thereby beginning an extension of the nozzle pipe 6*a* toward the inner space 92 of the toilet bowl 90. Just before the nozzle pipe 6*a* reaches its fully extended position or operating position, the valve body 13*a* is opened and the washing water is injected from the holes 6*a* toward the user's anus and its surrounding portion.

When the washing button 85 is turned off, the electromagnetic opening and closing valve 56 is closed temporally, thereby terminating the supply of the water under pressure to the changeover valve 4. Thereafter, the control valve 40 is set to take the conditions (E), (F) and (A) in this order (FIG. 9). Immediately after the changeover valve 4 has taken the position (A), the electromagnetic opening and closing valve 56 is opened again and the water under pressure is fed to the distal side chamber Rc of the first cylinder 7*a* via the passageway 51*d* and the passageway 51*a* which are in fluid communication with each other when the control valve 40 takes the condition (A). Thus, the nozzle pipe 6*a* is returned to its retracted position by the biasing force of the return spring 11*a* and the water pressure being supplied into the distal side chamber Rc, whereby despite of a residual pressure in the base side chamber Sa of the first cylinder 7*a*, the retracting movement of the nozzle pipe 6*a* can be established quickly or smoothly.

In addition, the water supply to the distal side chamber Rc of the first cylinder 7*a* during the retracting movement of the nozzle pipe 6*a* means that the first cylinder 7*a* and the nozzle pipe 6*a* are set to be washed.

If the female's pubic portion is desired to be washed, a washing button 86 (FIGS. 7 and 8) is turned on, like the anus washing, the pubic portion washing is established except that the CPU 80 orders the changeover valve 4 so that it takes positions (A)–(F) in such order shown in FIG. 10.

The invention has thus been shown and described with reference to reference to a specific embodiment, however, it should be noted that the invention is in no way limited to the details of the illustrated structures but changes and modifications may be made without departing from the scope of the appended claims.

What is claimed is:

1. A sanitary device comprising:

a tank storing an amount of water;

a water pressure source;

a cylinder;

a nozzle pipe slidably fitted in the cylinder such that a base side chamber and a distal side chamber are defined in the cylinder, the base side chamber being separated from the distal side chamber by the nozzle pipe;

a return spring accommodated in the distal side chamber and urging the nozzle pipe toward the retracted position thereof; and a control means serving for establishing either a first fluid communication between the tank and the base side chamber or a second fluid communication between the tank and the distal side chamber in such a manner that the first fluid communication brings the nozzle pipe into its operating position for ejecting the water while the water pressure is being supplied to the tank and the second fluid communication, together with the return spring, brings the nozzle pipe into is retracted position; wherein the control means includes an electromagnetic valve disposed between the water pressure source and the tank, a changeover valve connecting the tank to either the base side chamber or the distal chamber, a CPU for controlling the electromagnetic valve and the changeover valve; and wherein the changeover valve includes a rotary plate having a passageway being in fluid communication with the tank, and a stationary plate having a pair of passageways which are in fluid communication with the base side chamber of the cylinder and the distal side chamber of the cylinder, respectively, the rotary plate being set to bring fluid communication of the passage of the rotary plate, upon rotation thereof, with either of the pair of the passageways.

* * * * *